United States Patent [19]

Baumberg

[11] Patent Number: 4,801,246

[45] Date of Patent: Jan. 31, 1989

[54] DEVICE FOR ELEVATING LIQUIDS WITH A PLURALITY OF INTERMEDIATE CONTAINERS COMMUNICATING WITH ONE ANOTHER

[75] Inventor: Iosif Baumberg, Brooklyn, N.Y.

[73] Assignee: Danmin Software and Technology, Inc., Fair Lawn, N.J.

[21] Appl. No.: 83,979

[22] Filed: Aug. 11, 1987

[51] Int. Cl.[4] ..... F04F 1/04; F04F 1/18

[52] U.S. Cl. ..... 417/121; 417/118; 417/149; 417/208; 126/433; 126/434

[58] Field of Search ..... 417/54, 52, 65, 85, 417/86, 118, 121, 149, 207–209, 379, 108; 126/433, 434

[56] References Cited

U.S. PATENT DOCUMENTS

| | | | |
|---|---|---|---|
| 776,106 | 11/1904 | Beurrier | 417/149 |
| 1,154,745 | 9/1915 | Browne | 417/108 |
| 1,811,295 | 6/1931 | Blow | 417/108 |
| 4,431,385 | 2/1984 | O'Hare | 417/209 X |
| 4,519,749 | 5/1985 | Baumberg | 417/108 X |
| 4,527,956 | 7/1985 | Baumberg | 417/121 X |
| 4,583,918 | 4/1986 | Baumberg | 417/379 X |
| 4,671,741 | 6/1987 | Baumberg | 417/108 X |

FOREIGN PATENT DOCUMENTS

| | | | |
|---|---|---|---|
| 662463 | 5/1963 | Canada | 417/121 |
| 2733995 | 2/1979 | Fed. Rep. of Germany | 417/379 |
| 441332 | 5/1912 | France | 417/85 |
| 461374 | 10/1913 | France | 417/121 |
| 1025430 | 1/1953 | France | 417/118 |
| 2357762 | 2/1978 | France | 417/379 |
| 2440479 | 7/1980 | France | 417/379 |
| 985460 | 12/1982 | U.S.S.R. | 417/118 |
| 1096404 | 6/1984 | U.S.S.R. | 417/118 |

*Primary Examiner*—Paul F. Neils

*Attorney, Agent, or Firm*—Ilya Zborovsky

[57] ABSTRACT

In a device for elevating liquids a heat exchanging vessel to be neated by an exterior source of heat is connected with a discharge pipe arranged to elevate doses of liquid, so that for performing a thermodynamic cycle the liquid to be elevated is used as a working medium, the liquid is introduced into the heat exchanger after an end or before a beginning of each thermodynamic cycle in a quantity which does not exceed a quantity required for one thermodynamic cycle and is heated in the heat exchanger, and issuance of the elevated liquid is performed under the action of pressure difference which acts on the discharge pipe and which has a value not exceeding a value of pressure difference which elevates a dose of liquid.

15 Claims, 3 Drawing Sheets

DEVICE FOR ELEVATING LIQUIDS WITH A PLURALITY OF INTERMEDIATE CONTAINERS COMMUNICATING WITH ONE ANOTHER

BACKGROUND OF THE INVENTION

The present invention relates to a device for and method of elevating liquids.

Devices of the above mentioned general type are known in the art. The devices for elevating liquids through a discharge pipe with the utilization of solar or wind energy are disclosed in the U.S. Pats. Nos. 4,519,749 and 4,583,918, while the pipes for elevation of doses of liquids are disclosed in the U.S. Pats. Nos. 4,527,956 and 4,671,741. The devices disclosed in the U.S. Pats. Nos. 4,519,749 and 4,583,918 include a container- heat exchanger, an element which forms a dose of liquid, a discharge pipe, one or two liquid valves, and air taking diffuser. The operation of these devices is based on pushing from below upwardly of the formed doses of liquid through the discharge pipe by an expanding air during its heating in the heat exchanger. The elevation of the doses of liquid which in the discharge pipe assume the shape of liquid plugs or small columns, can be performed with the aid of the special pipes, for example the pipe disclosed in the U.S. Pat. No. 4,527,956. The inner space of this pipe is filled, with some interspaces, with a plurality of discs which are perforated. The diameter of perforations in the discs, the distance between the discs, and the value of forces of molecular interaction between the liquid and of the material of the discs produce such excessive capillary pressure that the plug of liquid in the vertical pipe is not dispersed and is not lowered under the action of gravity.

The pipe disclosed in the U.S. Pat. No. 4,671,741 also provides elevation of separate doses of liquid. Under the action of pressure difference, a dose of liquid is pumped from a lower container into an upper container through a pair of pipes, one of which insures the pumping of liquid while the other of which insures equalization of gas pressure in the lower and upper containers after pumping the dose of liquid from the lower to the upper level.

The devices disclosed in the U.S. Pats. Nos. 4,519,749 and 4,583,918 have some disadvantages, which include a complicated construction because of the use of liquid valves, consumption of a part of received energy for activating of the liquid valves, time spent for blowing through of the heat exchanger, limited coefficient of thermal expansion of gaseous working medium (air) and therefore use of the heat exchanger having a large volume which can exceed 10 times the volume of other parts in the event of 30° C. range (between 30° C. and 60° C.) of the thermodynamic cycle of operation of the device, limitation of the temperature coefficient of change in pressure of working medium by the value which is determined by the dependency of gas pressure from its temperature, absence of interrelationship between the time of running of phases of the thermodynamic cycle and intensity of wind action, and finally the necessity of having simultaneously two independent sources of energy , namely wind energy and thermal energy.

The disadvantages of the pipe disclosed in U.S. Pat. No. 4,527,956 include a relatively high resistance to flow of of liquid in the pipe because of the obstacles formed by the discs in the pipe, as well as maintenance expenses for cleaning dirt in the perforations of the discs and between the discs.

SUMMARY OF THE INVENTION

Accordingly, it is a general object of the present invention to provide a device for and method of elevating liquids, which avoids the disadvantages of the prior art.

More particularly, it is an object of the present invention to provide a device for and a method of utilization of solar energy, wind energy, energy of waste or natural energy sources for elevating liquid, for example a heat source which changes the temperature of working medium of a heat engine relative to ambient temperature by 20°–30°, or a source of compressed or rarified air with a pressure exceeding atmospheric pressure by 50–100 mm hg column.

It is also an object of the invention to provide a device and a method which , with the use of thermal energy utilizes the principle of operation of a piston machine in which the working medium is a liquid to be elevated, the piston is a dose of the elevated liquid, and the cylinder is a discharge pipe with a stepped construction which does not limit the height of elevation of liquid, wherein in contrast to the known piston machine the inventive device does not have a step of returning the piston to its initial position.

It is also an object of the present invention to provide a device and method of elevating liquids, in which when the energy of compressed gas (vapor) is used as a motive power, no devices for transforming thermal energy into the energy of compressed gas (vapor)are needed; for example , in the event of use of a heat exchanger, no device for introducing into it a separate working medium is needed.

In keeping with these objects and with others which will become apparent hereinafter, one feature of the present invention resides, briefly stated , in a device which has a heat exchanging vessel for heating of a working medium which is a liquid to be elevated, and a discharge pipe connected with one another so that a liquid to be elevated is a working medium which is heated in a quantity which does not exceed the quantity required for performing one thermodynamic cycle, the liquid is introduced into the heat exchanger after the end or before the beginning of each thermodynamic cycle in a required quantity, and issuance of the elevated liquid into ambient atmosphere is performed under the action of a pressure difference with acts on the pipe and has a value which is equal to or greater than the pressure difference which elevated a dose of liquid.

When the device is designed and the method is performed in accordance with the present invention, the above objects of the invention are achieved.

Heat losses are minimized since only minimal quantity of working medium is heated, which is required for performing only one closed thermodynamic cycle. The heating of minimal quantity of working medium also insures a minimal delay between the variation of speed of heat supply from the heat carrier and the process of utilization of the received heat, which in condition of variations of heat carrier temperature reduces thermal energy losses. The thermodynamic cycle which takes place in accordance with the invention substantially corresponds to Renkin cycle, with higher efficiency coefficient as compared with the processes running in accordance with Carno cycle.

The novel features of the present invention are set forth in detail in the appended claims. The invention itself, however, both as to its construction and manner of operation will be best understood from the following description of preferred embodiments which is accompanied by the following drawings.

DESCRIPTION OF PREFERRED EMBODIMENTS

A device for elevating liquids as shown in FIGS. 1–8 has a discharge pipe which includes a plurality of liquid accumulating intermediate containers **1.1–1.*n* which are located at equal distances one above the other. Each liquid accumulating container 1.*k* ($k=1,2,\ldots,n-1$) is connected with the respective lower container 1.*k*+1 by a pair of pipe portions 2.*k* and 3.*k*** which are located at the same height and have equal lengths. The edges of the upper ends of the pipe portions of each pair are located in a horizontal plane.

Figure 10:
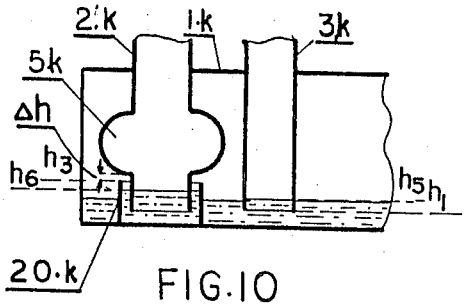

The pipe portions **3.*k* are rectilinear and their axes are vertical. Each pipe portion 2.*k* has a lower end which is bent upwardly so that its upper open edge faces up as identified with reference 4.*k* in FIGS. 1–8,9 and 11),or its lower end is inserted in a cup as identified with reference 20.*k* in FIGS. 10 and 12. The lower ends of the pipe portions 2.*k* and 3.*k* are located in the respective container 1.*k* at the height $h_1$ from its bottom. For the pipe portions 2.*k* the lower bend starts at the height $h_1$. The upper ends of the pipe portions 2.*k* and 3.*k* are located in the container 1.*k*+1 at the height $h_2>h_1$ from the bottom of the container 1.*k*+1 as more clearly shown in FIG. 13**.

The edge of the bent end **4.*k* of the pipe portion 2.*k* (which is a bubbling pipe portion) or the edge of the cup 20.*k* into which the lower end of the pipe portion 2.*k* is inserted, is located at the height $h_3$ from the bottom of the container 1.*k*** and corresponds to the ratio $h_1<h_3<h_2$.

A part **5.*k* of the pipe portion 2.*k* whose lower section is located at a height $h_3+\Delta h$ has the area of the horizontal section which is greater than the area of the remaining part of this pipe portion. The height of this part 5.*k* ( bubbling part of chamber) is shorter than the height of the bend 4.*k* of the pipe portion 2.*k*, and also shorter than the height of the ring formed between the pipe portion 2.*k*($h_3-h_1$) and the cup 20.*k*. The volume of the part 5.*k* is greater than the volume of the bend 4.*k* of the pipe portion or of the ring between the pipe portion 2.*k* and the cup 20.*k***.

The bubbling part **5.*k* can have an oval or round cross section. The height $\Delta h$ must be such that the bubbling part 5.*k* does not prevent entering of the liquid into the bend 4.*k* of the pipe portion 2.*k* or into the cup 20.*k***.

An inlet of the discharge pipe is formed by a rectilinear pipe portion 6 which is connected with the lowest container 1.1. For example, it is inserted through the bottom of the container 1.1 and reaches such height $h_4$ (FIG. 14) that the container 1.1 can accumulate liquid with a volume which is determined by a dose of the liquid to be elevated. The outside part of the inlet pipe portion 6 has a height $H_2>H_1$ and can be inserted into a reservoir 19 with liquid to be elevated (FIGS. 1–8 and 14) to the depth $H_3$ which satisfies the ratio $H_2>H_3>H_1$, wherein $H_1$ is a height of the pair of the pipe portions.

An upper outlet of the discharge pipe is formed by a pipe portion 7 provided with a plurality of flat vertically spaced parallel discs 8 each having a plurality of perforations, for the case when the outlet opening of the discharge pipe is higher than the uppermost container **1.*n* (FIGS. 1–8). Or it is formed as a discharge pipe portion 22 (FIG. 15) located lower than the uppermost container 1.*n*. The pipe portion 22 is located in the uppermost container through its bottom and ends in a hydraulic resistor (throttle) or hydraulic diode 23 shown in FIG. 15**.

The upper outlet of the discharge pipe is connected via a pipe portion 9 with an auxiliary vessel 10 with a discharge pipe portion 11. One leg of a U-shaped pipe 12 is inserted into the auxiliary vessel 10. A regulating needle is arranged on the bend of the pipe 12 as identified with reference 13. The second leg of the pipe 12 is connected with an upper part of a heat exchanger 14. The heat exchanger 14 accommodates a plurality of bottoms which act as individual evaporators 15 which have rough or ribbed surface. The lower part of the heat exchanger 14 is connected via a pipe 16 with an upper part of the lowest container 1.1. A conical member 17 is attached to the top of the container 1.1 at the lower side of the top, coaxially with the inlet pipe portion 6.

Figure 1:
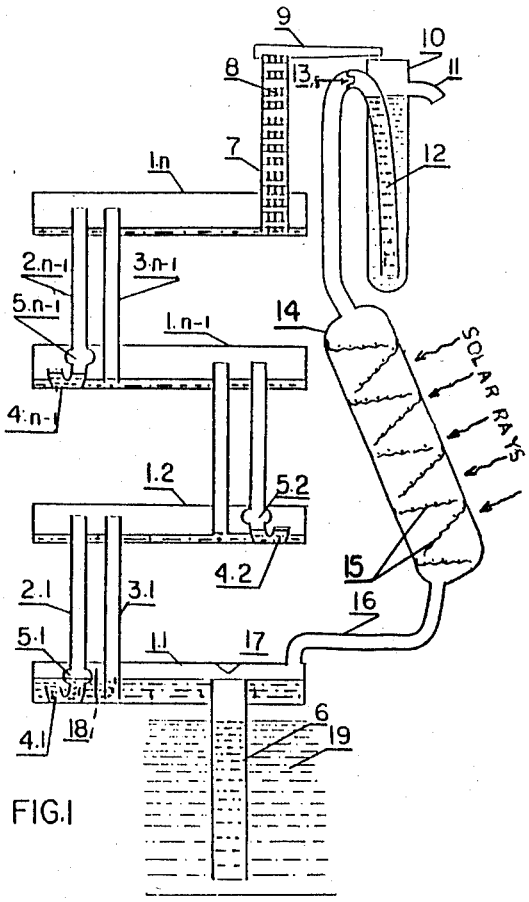
FIGS. 1–8 are views which schematically show a device for elevating liquids in accordance with the present invention, in different phases of its operation.
Figure 14:
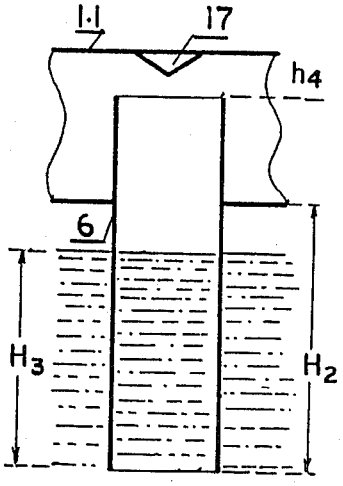
FIG. 14 is a view showing an inlet region of the discharge pipe of the device for elevating liquids in accordance with the present invention.

The lowest container 1.1 is subdivided by a partition 18 into two parts, so that the bubbling pipe portion **2.*k* is located in one part of a lower volume, while the pipe portion 3.*k* is located in the other part of a greater volume. The upper and lower parts of the partition 18 have openings through which two parts of the container 1.1** communicate with one another. Operation:

FIGS. 1–8 show various phases of thermodynamic working cycle of the operation of the device of the present invention. The initial position is shown in FIG. 1 and corresponds to the point A of the diagram of thermodynamic cycle shown in FIG. 16. The inlet pipe portion 6 of the device is introduced into a liquid 19 to be elevated to the depth $H_3$ as shown in FIG. 14. The lowest container 1.1 is filled with liquid to the height $h_4$(FIG. 14). In other containers 1.i , wherein $i=2,3,\ldots,n-1$ and in the pipe portions **3.*i* the level of liquid is located at the height $h_5$ from the bottom of the container 1.*i* (FIGS. 9 and 10), wherein $h_1<h_5<h_3$. The level of liquid in the bend 4.*i* of the pipe portions 2.*i* or in the cups 20.*i* is at the height $h_6$ (FIGS. 9 and 10), wherein $h_3 \geqq h_6 > h_5$. The level of liquid in the uppermost container 1n is $h_8$, wherein $h_8$ equal to the height of the lower end of the outlet pipe portion 7 above the bottom of the uppermost container (FIGS. 1–8). On the other hand, $h_8$ is zero when the outlet of the discharge pipe is formed by the pipe portion 22 with the hydraulic resistor (throttle) or hydraulic diode 23 located lower than the bottom of the uppermost container. The level of liquid in the inlet pipe 6 corresponds to the level of liquid in the reservoir with liquid 19 to be elevated. The level of liquid in the auxiliary vessel 10 and the introduced leg of the U-shaped pipe portion 12 corresponds to the level of the discharge pipe portion 11. The bottoms 15 retain in their depressions the liquid supplied from the previous cycle, and the pressure of air and vapor of the liquid in the heat exchanger 14, the containers and the pipe portions equal to the pressure of ambient atmosphere. Liquid which is not retained in the depressions of the rough or ribbed surface of the bottoms 15 flows via the pipe portion 16, the container 1.1 and the pipe portion 6 into the reservoir of the liquid 19**

Figure 2:
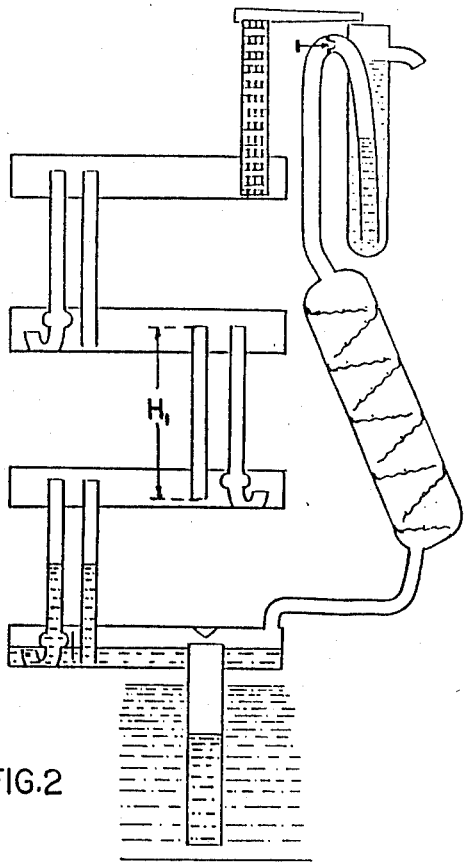
Figure 3:
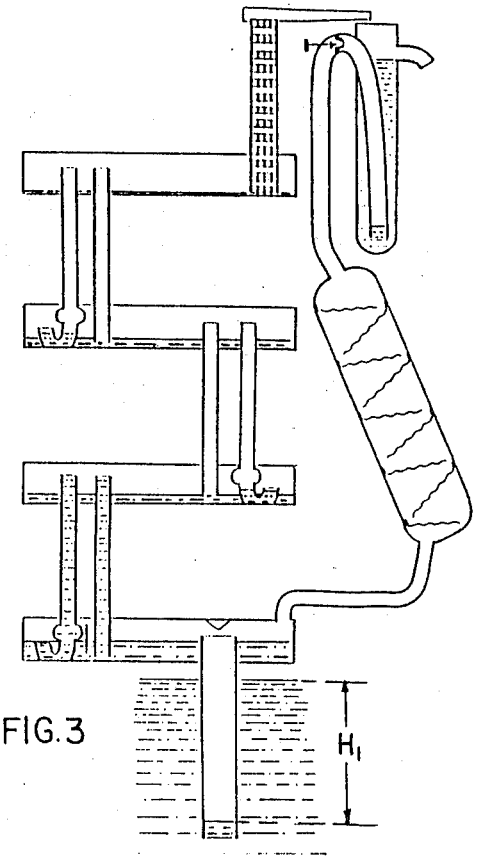

As a result of heating of the heat exchanger 14 and transfer of energy to the working medium in the latter (the heating can be performed by sources which will be explained below, the working medium is a liquid to be elevated in device), the pressure of air and vapor increase, the liquid in the pipe portions 2.1 and 3.1 is lifted upwardly, and correspondingly the liquid in the pipe portions 6 and 12 lowers (FIG. 2). At the pressure $P_2 = P_o + P_1$ the pipe portions 2.1 and 3.1 are filled, while the level of liquid in the pipe portion 6 and in the leg of the pipe 12 introduced into the auxiliary vessel 10 lowers by the value $H_1$ (FIG. 3), wherein $P_1$ is the pressure of the column of elevated liquid with the height $H_1$. The point B of the diagram of the thermodynamic cycle in FIG. 16 corresponds to the position of the system shown in FIG. 3. Since the volume of the heat exchanger considerably exceeds the volume of the pair of pipe portions **2.*k* and 3.*k*, and during the subsequent stages of elevations of liquid the height of the liquid in the pipe portions 2.*k* and 3.*k* remains equal $H_1$ while the level of liquid in the pipe portions 6 and 12** remains lower than that in the reservoirs in which they are inserted ( by the value $H_1$), the transition from the position A to the position B can be considered as an isochoric process and the line AB is an isochore.

Figure 4:
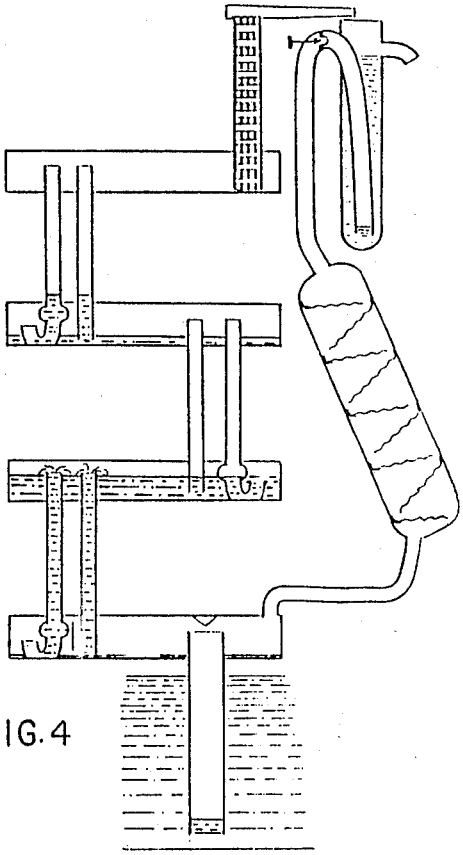
Figure 5:
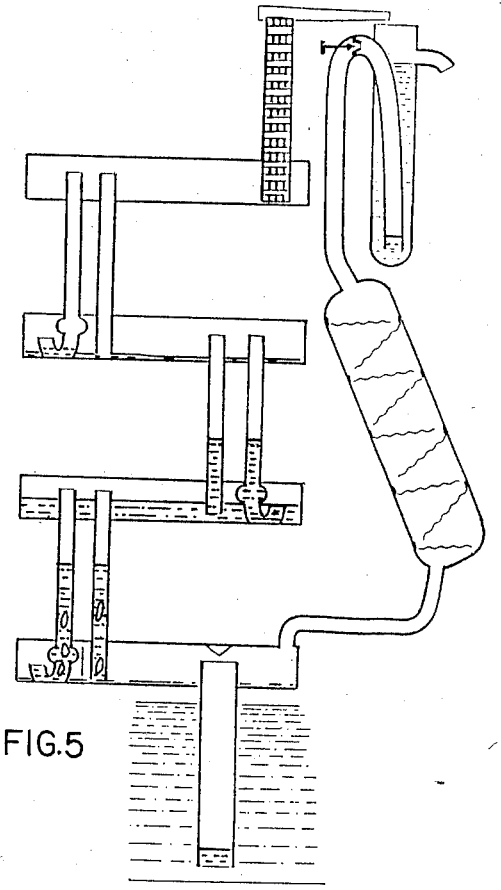
Figure 6:
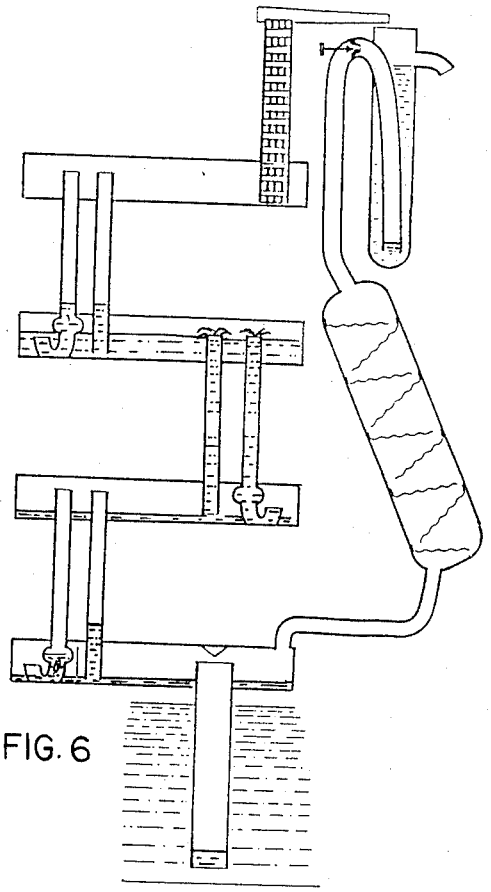
Figure 7:
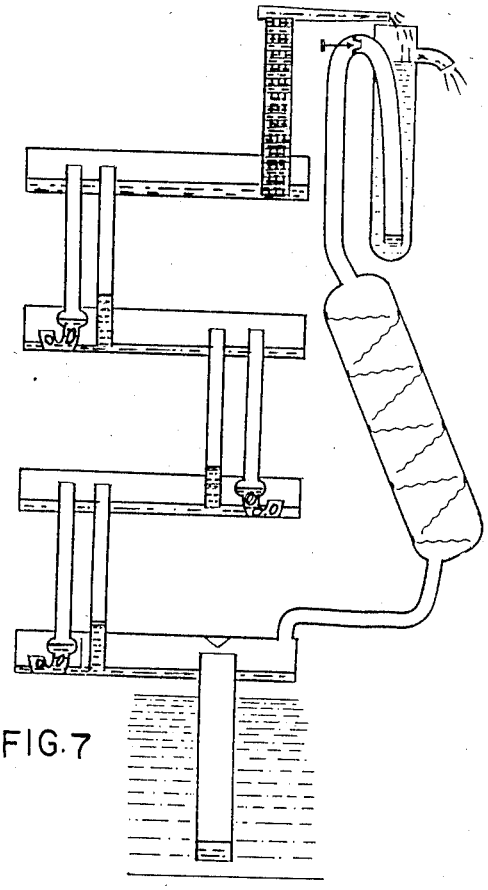
Figure 11:
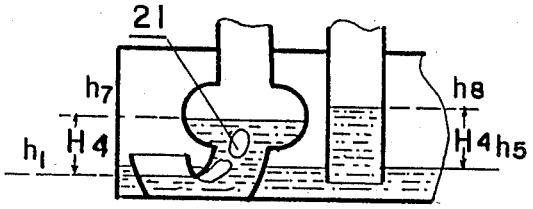
Figure 12:
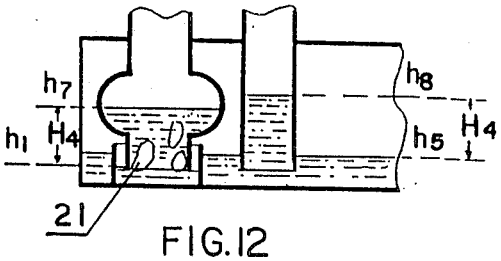
Figure 13:
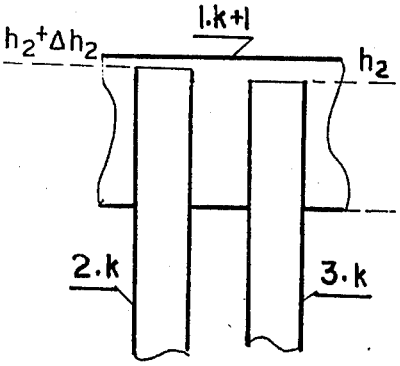
FIG. 13 is a view showing a position of upper ends of the pair of pipe portions in one of the liquid accumulating containers.

The further supply of energy into the heat exchanger leads to the flowing of the liquid from the container 1.1 to the container 1.2 (FIG. 4) . Since the value $H_1$ considerably exceeds the value $h_4$, pumping of the liquid from the container 1.1 to the container 1.2 takes place in accordance with isochore-isobar. The position shown in FIG. 4 corresponds to the point C on the thermodynamic diagram of FIG. 16, while the line BC corresponds to the isochoreisobar. Subsequent supply of heat leads to an increase of pressure of gas (vapor) and its excess over the value $P_1$. The gas (vapor) starts to bubble through the pipe portions 2.1 and 3.1 and flow into the container 1.2, and as a result of this the pressure of gas (vapor) in the container 1.2 increases and the pressure difference at the ends of the pipe portions 2.1 and 3.1 decreases with corresponding decrease of the liquid column in the latter. Simultaneously with the decreases of the height of the liquid column in the pipe portions 2.1 and 3.1, the height of the liquid column in the pipe portions 2.2 and 2.3 starts to increase (FIG. 5). At the gas (vapor) pressure in the heat exchanger equal to $P_2 + \Delta P$ the liquid from the second container 1.2 flows to the third container 1.3. $\Delta P$ is a pressure of the liquid column with the height $H_4 = h_7 - h_1$, wherein $h_7$ is a height from the bottom of the container **1.*k* to the level of the liquid in the bubbling chamber 5.*k*, if the liquid level decreased from the position in which the liquid level in the bend 4.*k* of the pipe portion 2.*k* and in the pipe portion 2.*k* itself of the $h_3$ to the value $h_1$ in the bend 4.*k* or in the cup 20.*k*, under the action of gas pressure. The greater in the area of the horizontal cross section of the bubbling chamber 5.*k*, the lower is the value $H_4$ (FIGS. 11 and 12). Thus, the liquid flows from the second container 1.2 to the third container 1.3 (FIG. 6). This corresponds to the point C of the thermodynamic diagram of FIG. 16**.

Figure 8:
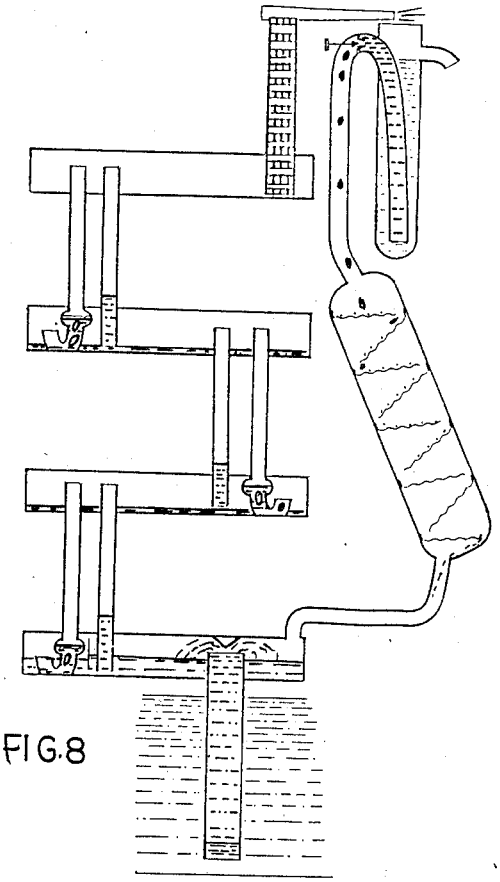
Figure 9:
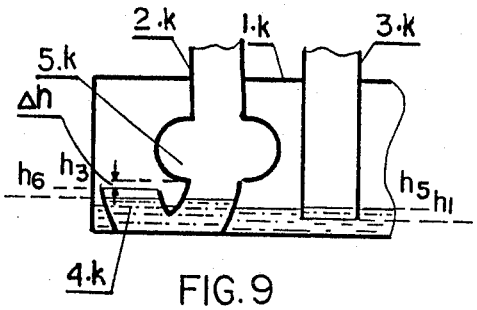
FIGS. 9–12 are views showing constructions of and processes running in lower parts of pairs of pipe portions which connect intermediate liquid accumulating containers of the device for elevating liquids in accordance with the present invention.
Figure 15:
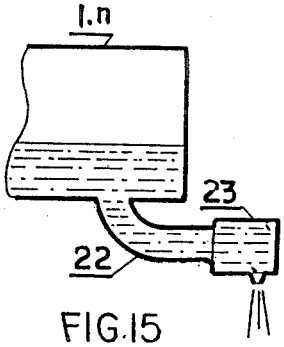
FIG. 15 is a view showing a hydraulic resistor or hydraulic diode at an outlet end of the discharge pipe of the inventive device.

The process of flowing the liquid from a lower container **1.*k* to an upper container 1.*k*+1 takes place when the gas pressure in the system increases from the value $P_2 + (k-1)\Delta P$ to the value $P_2 + k\ \Delta P$. Therefore the pressure in the system will be increasing in a stepped manner by the value $\Delta P$ during pumping of the liquid from one container 1.*k* to the other container 1.*k*+1. During this, the gas volume which is under the pressure $P_2 + k\ \Delta P$ increases by the value $\Delta V$, wherein $\Delta V$ is a total volume of the container 1k and the pipe portions 2.*k* and 3.*k*. In the pipe portion 3.*k* the level of liquid is higher than the level of liquid in the container 1.*k* by the value $H_4$, however the gas 21 will not bubble through the latter (FIGS. 11 and 12) since the end of the pipe portion 3.*k* is introduced into the liquid by the depth equal to $h_5 - h_1$. After the pressure in the system reaches the value $P_3 = P_2 + (n-1)\ \Delta P$, the liquid will start to be pushed out through an outlet end of the pipe portion 7 (FIG. 7) or 22 and 23 (FIG. 15). For pushing the liquid out of the outlet end of the pipe portion 7 or 22, a pressure difference must be created at the ends of this pipe portion, which is not less than the value $P_1$. This is necessary, on the one hand, for pushing the liquid from the pipe portions 2.(*n*−1) and 3.(*n*−1) into the container 1.(*n*−1), and on the other hand, so that the issuance of the elevated dose of liquid will take place in a pulsating manner ( as a pulse) as shown in FIG. 8. As a result of the pulsating ending of the issuance of the does of liquid, fast drop of pressure takes place in the system which includes the heat exchanger , the containers and the pipe portions connecting the same. As a result of this, an adiabatic expansion of gas takes place in the system, which is connected with the drop in the temperature and equilization of liquid level in the pipe portions 6 and 12** with the level of the liquid in which they are introduced.

Figure 16:
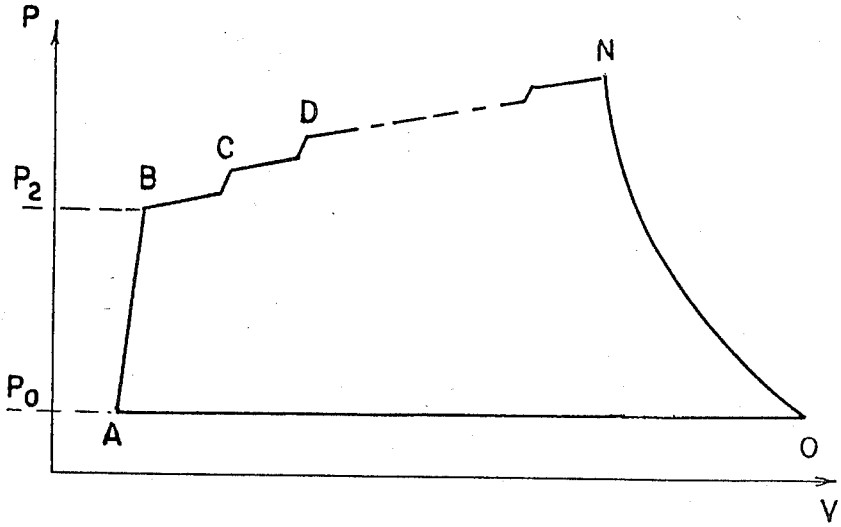
FIG. 16 is a view showing a diagram of thermodynamic condition of a system formed by the device in accordance with the present invention.

In connection with the pulse nature of dehermetization of the system corresponding to the point N in FIG. 16, the liquid columns in the pipe portions 6 and 12 pass, as a result of inertia, higher than the level of liquid in which they are introduced. The liquid elevated in the pipe 6 is reflected from the surface of the conical reflecting member 17 and fills the container 1.1 to the height $h_4$. The diameter of the pipe portion 6 is selected so that the liquid supplied through it into the container 1.1 insures the required volume of the liquid dose being elevated. In the pipe portion 12 the liquid reaches the region of the bend, passes through an opening which is regulated by the needle 13, and flows into the heat exchanger (FIG. 8). The quantity of the thusly flowing liquid is determined by means of the needle 13. A small cross section in the region of the needle prevents any possibility of siphoning out of the liquid from the vessel 10 by the pipe 12 to the heat exchanger 14.

In the heat exchanger 14 the liquid flows from one to the other bottom 15 and is retained (delayed) on the rough surfaces of the same , which form evaporators. If more liquid is supplied into the heat exchanger than needed for one thermodynamic cycle, then the excessive liquid flows down through the pipe portion 16 into the reservoir of the liquid 19 to be elevated. The elevated dose of liquid flows through the pipe portion 9 into the auxiliary vessel 10 and then from the latter flows into an ambient space through the pipe portin 11 (FIGS. 1–8). This insures the constant filling of the vessel 10.

Heating of the heat exchanger can be performed in many different ways, for example by the energy of solar rays even without special concentrating and focusing devices or with the use of the greenhouse effect; by the energy of waste heat in form of heated liquids, gases, natural thermal sources. The source of energy can also be sources of compressed gas, in which case the heat exchanger can be used as an intermediate container.

It is possible that the lower ends of the pipe portions 2.*k* and 3.*k* are located at the same height $h_1$ in the container 1.*k*, while the upper ends of the same pair of pipe portions in the container 1.*k*+1 are located at different heights, so that the upper end of the bubbling pipe portion 2.*k* is at the height $h_2+\Delta h_2$ and the upper end of the other pipe portion 3.*k* of the same pair is at the height $h_2$, wherein $\Delta h_2 \geqq 0$. This helps to more clearly distinguish the functions of the pipe portions of the pairs, which precludes the possibility of occurrence of oscillating process during the last stage of pumping the liquid which is elevated from the container 1.*k* to the container 1.*k*30 1. With this construction the bubbling (barbotating) pipe portion 2.*k* is used only for transfer of the gas from the container 1.*k* into the container 1.*k*+1, while the pipe portion 3.*k* is used for pumping the liquid from the container 1.*k* into the container 1.*k*+1.

It should be emphasized that the release of k pair of pipe portions 2.*k* and 3.*k* from liquid is performed as a result of equalization of pressure in k and k+1 intermediate container 1.*k* and 1.*k*+1 which are connected by the pipe portions 2.*k* and 3.*k*. Liquid which remained in the pipe portions 2.*k* and 3.*k* flows into the container 1.*k*. After issuance of the lifted dose of liquid from the top container 1.*n* outwardly through the pipe 22 the liquid which remains in the pipe portions 2.*n*−1 and 3.*n*−1 will not flow into the container 1.*n*−1 if in the last container 1.*n* there is no pressure which is equal to the pressure in the container 1.*n*−1. To produce the last mentioned pressure, the end of the pipe 22 is provided with a hydraulic resistance 23 which increases the pressure in the container 1.*n* to the value which is not less than the pressure of a liquid column with a height of the pipes 2.*n*−1 and 3.*n*−1 which connect the containers n−1 and n.

It should be emphasized that with the device of the present invention, it is therefore possible to elevate and issue any quantity of liquid at any height with a pressure difference which is not less ( equal or greater) than the pressure difference required for elevation of one dose of liquid. More particularly, the required pressure difference is equal or only insignificantly greater than the pressure difference required for elevation of one dose of liquid.

The invention is not limited to the details shown.

What is desired to be protected is set forth in claims. I claim:

1. A device for elevating liquids, comprising a heat exchanging vessel arranged to be heated by a source of heat and to receive a liquid which is vaporized and produces a high pressure vapor and after vaporization produces a suction;

an auxiliary vessel accommodating a liquid and connected with said heat exchanging vessel to supply a liquid into the latter to be heated and vaporized;

an inlet pipe connected with a source of a liquid; and a discharge pipe arranged to elevate doses of liquid and connected with said inlet pipe to receive the liquid from said inlet pipe, said discharge pipe being also connected with said heat exchanging vessel so that for performing a thermodynamic cycle the liquid to be elevated is used as a working medium in that the high pressure vapor produced in said heat exchanging vessel forces the liquid in said discharge pipe up and after the vaporization of the liquid the produced suction draws the liquid from said inlet pipe into said discharge pipe, said discharge pipe having a plurality of vertically spaced containers, a plurality of pairs of pipe portions each pair connecting two neighboring ones of said containers, and an emptying member located in each container and associated with one pipe portion of each of said pairs of pipe portions, one portion of each of said pairs of pipe portions having a lower end associated with said emptying member, said emptying member having a predetermined height, said one pipe portion of each of said pairs of pipe portions having a bubbling chamber located above said emptying member, said bubbling chamber having a height which is smaller and a volume which is greater than that of said emptying member.

2. A device as defined in claim 1, wherein said inlet pipe is rectilinear and has upper and lower ends, said upper end of said inlet pipe being inserted into a lowest one of said container to a height which is sufficient for accumulation in said lowest container of a liquid substantially equal to a dose of liquid to be elevated , said inlet pipe having a remaining part under said lowest container with a length sufficient for inserting said inlet pipe into a reservoir of the liquid to a depth which exceeds a height of said pipe portions.

3. A device as defined in claim 1, wherein said emptying member is formed as an upwardly bent lower end part of said one pipe portion, said bubbling chamber having a smaller height and a greater volume than those of said upwardly bent lower part of said one pipe portion.

4. A device as defined in claim 1 ; and further comprising an outlet pipe which is upright and has a tubular pipe element and a plurality of perforated discs inside the latter and spaced vertically from one another, said outlet pipe being connected with an uppermost one of said containers .

5. A device as defined in claim 1, wherein said one pipe portion of each of said pairs of pipe portions has a height which is greater than a height of another pipe portion of the same pair, said one pipe portion and said other pipe portion of each of said pairs of pipe portions having lower ends located at a same height.

6. A device as defined in claim 1, wherein said discharge pipe is arranged so that elevation and issuance of liquid is performed under the action of pressure difference which acts of said discharge pipe and which has a value which is equal to or only insignificantly greater than a value of pressure difference which elevated a dose of the liquid.

7. A device as defined in claim 1; and further comprising a U-shaped pipe which is bent upwardly and has one leg introduced into said auxiliary vessel and another leg introduced into said heat exchanger.

8. A device as defined in claim 7, wherein said U-shaped pipe has an upper bend; and further comprising a regulating needle inserted into said U-shaped pipe in the region of said bend and determining an area of cross section for passing the liquid between said legs of said U-shaped pipe.

9. A device as defined in claim 1, wherein said heat exchanger includes a heat conductive wall which limits an interior, and a plurality of bottoms located in said interior, said bottoms being also heat conductive and having a heat conductive contact with said wall, said bottoms being provided with means for retaining the liquid, said liquid retaining means being formed as projecting formations.

10. A device as defined in claim 9, wherein said projecting formations of said means for retaining the liquid on said bottoms include a plurality of ribs on said bottoms.

11. A device as defined in claim 9, wherein said bottoms are inclined to a horizontal plane and located so that the liquid in said heat exchanger flows from one bottom located above to another one bottom located below.

12. A device as defined in claim 1, wherein said lower end of said one pipe of each of said pipe portions has a cup in which said lower end of said one pipe is inserted so that a ring is formed between an outlet surface of said one pipe portion and an inner surface of said cup, said bubbling chamber having a smaller height and a greater volume than those of said ring.

13. A device as defined in claim 12; and further comprising an issuing pipe which is connected with said uppermost container and has a free end provided with an additional hydraulic resistance element

14. A device as defibed in claim 13, wherein said additional hydraulic element at the free end of said issuing pipe is formed as a hydraulic throttle.

15. A device as defined in claim 13, wherein said additional hydraulic element at the free end of said issuing pipe is formed as a hydraulic diode.

* * * * *